United States Patent [19]

Johnson

[11] 4,438,574

[45] Mar. 27, 1984

[54] ATHLETIC SHOE WITH TWO-PIECE UPPER FOREPART SECTION

[75] Inventor: Jeffrey O. Johnson, Raymond, N.H.

[73] Assignee: Nike, Inc., Beaverton, Oreg.

[21] Appl. No.: 362,061

[22] Filed: Mar. 26, 1982

[51] Int. Cl.[3] ..... A43B 23/00; A43B 5/00

[52] U.S. Cl. ..... 36/45; 36/129

[58] Field of Search ..... 36/45, 47, 48, 114, 36/128, 129, 72 R, 3 A, 83, 84, 87

[56] References Cited

U.S. PATENT DOCUMENTS

| | | | |
|---|---|---|---|
| Re. 23,922 | 1/1955 | Shapiro . | |
| 955,337 | 4/1910 | Lawlor . | |
| 1,258,629 | 3/1918 | Bliss . | |
| 2,147,197 | 2/1939 | Glidden . | |
| 2,380,050 | 7/1945 | Karp | 36/72 R |
| 2,552,700 | 5/1951 | Watts | 36/72 R |
| 2,563,751 | 8/1951 | Rossi et al. . | |
| 3,138,880 | 6/1964 | Kunzli . | |
| 3,583,081 | 6/1971 | Hayashi . | |
| 3,768,182 | 10/1973 | Powers . | |
| 3,769,723 | 11/1973 | Masterson . | |
| 3,793,750 | 2/1974 | Bowerman . | |
| 3,822,488 | 7/1974 | Johnson | 36/129 |
| 4,255,876 | 3/1981 | Johnson | 36/45 |

FOREIGN PATENT DOCUMENTS

| | | | |
|---|---|---|---|
| 1805151 | 2/1970 | Fed. Rep. of Germany | 36/3 A |
| 7008511 | 6/1970 | Fed. Rep. of Germany . | |
| 1960926 | 6/1971 | Fed. Rep. of Germany | 36/3 A |
| 1485624 | 10/1971 | Fed. Rep. of Germany . | |
| 2405091 | 8/1975 | Fed. Rep. of Germany . | |
| 2812760 | 7/1979 | Fed. Rep. of Germany | 36/128 |
| 778726 | 1/1935 | France . | |
| 2373244 | 7/1978 | France | 36/128 |
| 501291 | 11/1954 | Italy . | |
| 782562 | 9/1957 | United Kingdom . | |
| 1170571 | 11/1969 | United Kingdom . | |

*Primary Examiner*—James Kee Chi

*Attorney, Agent, or Firm*—Banner, Birch, McKie & Beckett

[57] ABSTRACT

An athletic shoe is disclosed. The athletic shoe includes an upper attached to a sole. The upper has a forepart section comprised of an inner layer and an outer layer. The inner layer is preferably formed of relatively thin stretchable leather and the outer layer is formed of a breathable nonstretchable material, such as nylon mesh. A slight gap is formed between the outer surface of the inner layer and the inner surface of the outer layer to allow the inner layer to stretch a limited degree in order to mold to the forepart portion of the foot of the wearer of the shoe.

31 Claims, 4 Drawing Figures

ATHLETIC SHOE WITH TWO-PIECE UPPER FOREPART SECTION

TECHNICAL FIELD

The present invention relates to athletic shoes, and in particular, to the construction of the forepart section of the upper. The athletic shoe of the present invention is particularly useful where it is desirable to keep the weight of the shoe at a minimum and to enhance the comfort of the forepart section of the upper without reducing the durability of the upper.

BACKGROUND OF THE INVENTION

Athletic shoes for use in various athletic activities, such as running, training, basketball, soccer, football and the like, have been constructed with uppers made of various materials. For example athletic shoe uppers have been constructed entirely of leather, entirely of synthetic materials or of a combination of leather and synthetic materials.

Where the athletic activity for which the shoe is used is primarily running, synthetic uppers are generally preferred because they are light and maintain their properties of comfort and softness regardless of exposure to moisture. However, synthetic uppers either do not stretch, or the synthetic uppers "give," that is move rather than stretch, in certain directions without forming to the foot. For example, oxford nylon does not stretch, while certain synthetic meshes stretch and/or move along their bias without forming to the foot. An example of a multi-layered synthetic upper is illustrated in U.S. Pat. No. 3,583,081 to Hayashi. The inner layer of material in the Hayashi upper is a woven or knit synthetic or natural fiber having higher elasticity as compared with the material of the outer layer. An intermediate layer of a resilient porous synthetic resin rubber or natural fiber is placed between the inner and outer layers.

When athletic shoe uppers are constructed entirely of leather, a balance has to be struck between the length of durability of the upper and its weight. In athletic endeavors, wherein the weight of the shoe is not critical but its strength or durability are, the leather upper has been made of relatively thick and heavy leather. Athletic shoes utilizing relatively thick leather generally take advantage of the capability of the leather to stretch and, hence, to mold or conform to the shape of the particular users foot. When relatively thick leather is utilized, or when the activity in which the shoe is used is not strenuous, the leather generally will not stretch to an extreme degree where the shoe becomes out of shape or ill fitting.

In certain athletic endeavors, for example running, in particular competitive running, the weight of the shoe becomes an important criteria. Relatively thin fine leather thus has been used in racing uppers. The stretching capability of the leather allows the upper material to mold itself to the form of the particular users foot. However, when such relatively thin leather is used, the stretching is unabated and the upper can eventually stretch out of shape. U.S. Pat. No. Re. 23,922 to Shapiro is an example of a track shoe having an all leather upper of kidskin and of an attempt to alleviate the stretching problem. A band of relatively nonstretching material is attached along the length of the leather upper to control stretching of the kidskin in the longitudinal direction. The relatively nonstretchable material does not cover the entire toe section, but rather extends as a band of less width than the upper from the toe of the upper to the heel of the upper. Thus, the strip of nonstretching material is intended to alleviate stretching primarily in the longitudinal direction.

Athletic shoe uppers have also been constructed of a combination of materials, for example, an upper with a toe section made of leather and a heel section of a synthetic woven fabric, such as nylon. An example of such an upper construction is found in U.S. Pat. No. 3,822,488 to Johnson.

Another example of a prior art upper constructed of various materials is found in U.S. Pat. No. 4,255,876 to Johnson. The upper in the '876 patent includes a toe section, which is multi-layered and stretchable, and a main body section, which is also multi-layered but non-stretchable.

Numerous current commercial running shoes have uppers with toe sections (sections forward of the metatarsal heads), which are stretchable and are formed of a combination of materials, and with a main body section rearward of the toe section, which is non-stretchable. The materials in the toe section typically are leather and a three layer laminate including an inner layer synthetic liner, a middle cushioning layer of synthetic foam, and an outer layer of synthetic multifilament mesh which stretches in all directions. Such a toe section is typically attached to the main body section formed primarily of a tight woven, nonstretchable synthetic material.

SUMMARY OF THE INVENTION

The present invention is directed to an improvement in an athletic shoe comprised of a sole and an upper attached to the sole. The improvement includes a multi-layered forepart section of the upper which extends around the shoes of the wearer of the athletic shoe. The forepart section includes an inner layer of a stretchable and moldable material and an outer layer of a breathable nonstretchable material. A major portion of the inner layer is left unconnected to the outer layer whereby the inner layer is free to stretch a limited degree to accommodate and mold to the forepart portion of the foot of the wearer.

The inner layer is preferably joined to the outer layer substantially along only the edges of the forepart section where the inner and outer layers join with the sole and with the remaining portion of the upper. The outer layer is preferably comprised of a nonstretchable mesh nylon, and the inner layer is preferably made of leather. The leather inner layer may be perforated to further reduce its weight. Such a perforated inner layer would be particularly suitable for a racing shoe wherein the weight of the shoe is particularly important. Also, the leather inner layer may be made of relatively thin leather. The conventional standard for specifying weight or thickness of leather is in ounces. For a given type of leather, the relative thickness or weight of the inner layer will vary. However, for a selected type of leather, the weight of leather in the forepart section will be less than the weight which would be required if the forepart section were made solely of the selected type of leather.

The inner and outer layers are preferably attached along their lower ends to the sole with the connection to the sole extending from a point behind the first metatarsal head on the medial side of the shoe, forward to the tip of the sole, completely around the forward end of the sole, and back to a point behind the fifth metatarsal head on the lateral side of the shoe. The rearward edge of the forepart section is preferably located rearward of all the metatarsal heads.

A shoe upper utilizing a forepart section of the present invention optimizes the desirable characteristics of the two materials used in the forepart section, while alleviating the problems associated with these materials. Thus, the stretch capability of leather can be utilized to accomplish a "glove-like" fit about the toes and metatarsal heads of the user. That is, the leather will stretch a limited amount to conform to the particular shape of the forepart section of the foot of the user. The weight of the leather is kept at a minimum, since very thin leather can be used. Additional reduction in weight and breathability can be attained by perforating the leather inner layer. However, the tendency of thin leather to stretch out of shape, that is beyond a proper fit about the toes and metatarsal heads of a particular user, is prevented by the use of the outer layer of nonstretchable material. The use of the nonstretchable mesh material again permits the weight of the shoe to be kept low, and the advantage of the breathability of the mesh material is also attained. These advantages of the mesh material are attained without the attendant discomfort which would occur if a nonstretchable material were placed in a tight conformity about the forepart section of the foot of the user. In the present invention, a gap exists between the inner and outer layers and the proper fit is attained by the stretchable inner layer of leather, rather than by the nonstretchable outer layer of mesh material.

Various advantages and features of novelty which characterize the invention are pointed out with particularity in the claims annexed hereto and forming a part hereof. However, for a better understanding of the invention its advantages and objects obtained by its use, reference should be had to the drawings which form a further part hereof, and to the accompanying discriptive matter in which there is illustrated and described an embodiment of this invention.

DETAILED DESCRIPTION OF THE INVENTION

Figure 1:
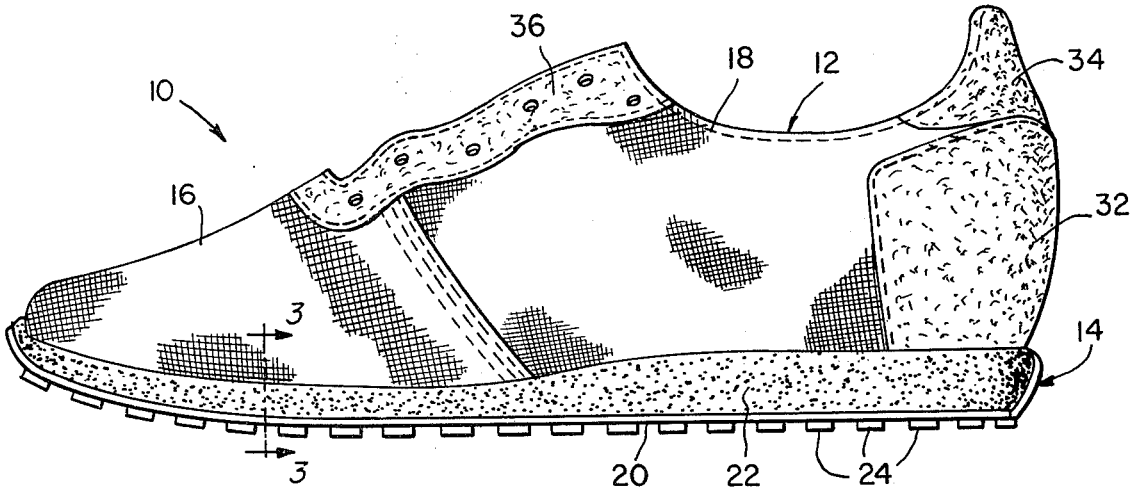
FIG. 1 is a side elevational view of an athletic shoe in accordance with the present invention.

Referring to the drawings in detail, wherein like numerals indicate like elements, there is shown in FIG. 1 an athletic shoe in accordance with the present invention designated generally as 10. The shoe 10 is comprised of an upper 12 attached to a sole 14. Upper 12 includes a forepart section 16 and a main body or rearpart section 18. The term forepart section refers to that portion of the shoe upper which extends over the toes of the wearer of the shoe, and preferably also over the metatarsal heads. Sole 14 includes an outer sole layer 20 and a midsole layer 22.

Outer sole layer 20 is preferably made of a resilient natural or synthetic rubber and includes a plurality of projections or cleats 24 molded integral with it. Midsole layer 22 may be made of either a single layer of material or multiple layers of material, and preferably includes a thickened heel lift. Midsole layer 22 is preferably made of a resilient cushioning material which is less hard than the outer sole layer 20, for example, the midsole layer 22 can be made of sponge rubber, EVA sponge or may incorporate channels of pressurized gas. Examples of cushioned midsoles are illustrated in U.S. Pat. Nos. 4,043,058 and 4,128,950. The use of channels of pressurized gas for cushioning within footwear is illustrated in U.S. Pat. Nos. 4,183,156 and 4,219,945.

The main body section 18 of upper 12 is preferably made of a light-weight nonstretchable material and extends about the arch and heel areas of the foot of a person wearing shoe 10. The main body section 18 may be made of a three layer "sandwich" wherein a synthetic foam layer 26 is held between two woven synthetic fabric layers 28, 30 with the outermost layer 30 being of a nonstretchable material such as tightly woven nylon or vinyl. Three layer uppers are illustrated in U.S. Pat. Nos. 3,793,750 and 4,255,876. The heel portion of the main body section 18 preferably includes heel reinforcing members 32 and 34 made of either leather or vinyl. Reinforcing members 32, 34 are attached to the outer surface of the main body section 18.

A lace hole reinforcement member 36 is attached to both the main body section 18 and a rearward upper portion of the forepart section 16. Lace hole reinforcement member 36 extends around a tongue opening 38 and is preferably made of a relatively strong wear resistant material such as leather. The reinforcement members 32, 34 and 36 are preferably sewn to the upper 12.

Forepart section 16 includes an inner layer 40 and an outer layer 42. Inner layer 40 is made of a breathable, stretchable and moldable material, while outer layer 42 is made of a breathable, nonstretchable material. Inner layer 40 is preferably made of leather or a leather-like material, and outer layer 42 is preferably made of a synthetic mesh, nonstretchable material, such as nylon mesh. A suitable mesh material has been found to be monofilament nylon mesh. This monofilament nylon mesh is preferably a square weave mesh of at least 400 denier. When the inner layer 40 is made of leather, the particular leather of which the inner layer 40 is made can be thinner than the thickness of the particular leather, which would be required to make the forepart section 16 sturdy enough so that it would not stretch out of shape when the forepart section is made only of the particular leather and the shoe 10 is used in its intended athletic endeavor. For example, if inner layer 40 were made of split cowhide, two ounce leather could be used. If a forepart section of an athletic shoe were to be made solely split cowhide, four ounce leather would generally have to be used so that the forepart section would not stretch out of shape. Similarly, if pigskin were used for inner layer 40, two ounce leather would suffice, while three ounce leather would generally be required to make a forepart section entirely of pigskin. On the other hand, a forepart section could be made entirely of two ounce kidskin, however the cost of the shoe would increase because kidskin is an expensive type of leather.

A major portion of the area over which the inner and outer layer 40, 42 overlap, the inner and outer layers 40, 42 are unconnected to one another. Inner and outer layers 40, 42 are preferably connected to one another substantially only where the layers 40, 42 are connected to the sole 14 and the remainder of the upper 12, i.e., the main body section 18 and the lace hole reinforcement member 36. Of course, additional stitching between layers 40 and 42, for example for decorative purposes, is within the scope of the invention, as long as the function of allowing inner layer 40 to stretch and mold a limited degree can still be satisfactorily accomplished.

Figure 2:
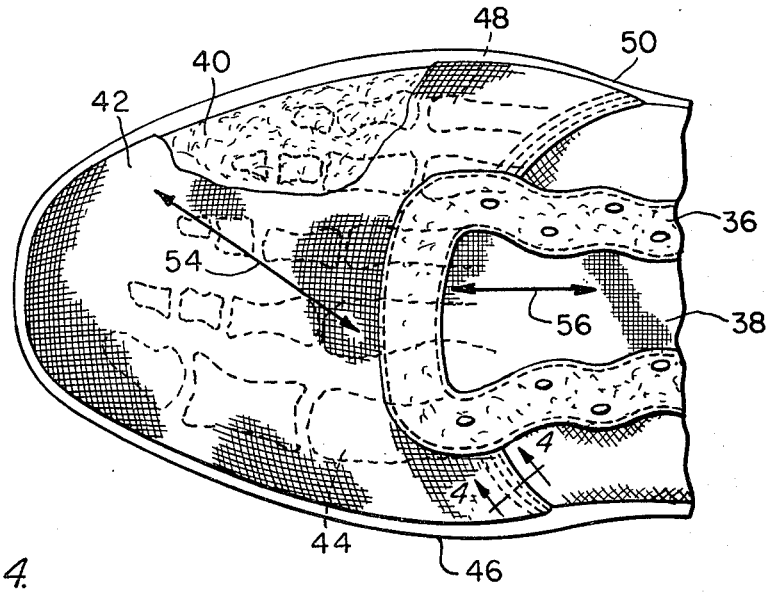
FIG. 2 is an enlarged top plan view, partially broken away, illustrating the toe section of the athletic shoe.
Figure 4:
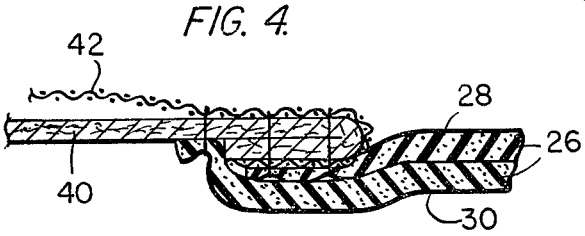
FIG. 4 is a sectional view taken generally along line 4—4 of FIG. 2.
Figure 3:
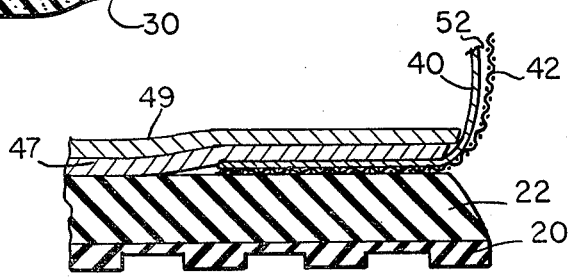
FIG. 3 is a sectional view taken generally along line 3—of FIG. 1.

The preferred extent of the forepart section 16 and its attachment to the shoe 10 is best seen in FIGS. 2, 3 and 4. Inner and outer layers 40, 42 of forepart section 16 extend from a point rearward of the first metatarsal head 44 on the medial side 46 of shoe 10 to a point rearward the fifth metatarsal head 48 on the lateral side 50 of shoe 10. In this manner, the forepart section 16 completely encircles the toes and metarsal heads of a wearer of shoe 10. The lower ends of layers 40, 42 are attached to one another and to the upper surface of midsole layer 22. Layers 40, 42 are preferably attached to the upper surface of midsole layer 22 by an adhesive. Layers 40, 42 are attached to the upper surface of midsole layer 42 from a point rearward of the first metatarsal head 44, along the lateral side 46 to the forwardmost tip of shoe 10, around the tip of shoe 10, and along the medial side 50 to a point rearward the fifth metatarsal head 48. Several layers of insole material 47, 49 overlay the upper surface of midsole layer 22 and the portions of layers 40, 42 attached thereto.

The rearwardmost portions of layers 40, 42 are sewn to the main body section 18 and the lace hole reinforcement member 36. Layers 40, 42 slant forwardly from their point of attachment to midsole layer 22 to the point of attachment to lace hole reinforcement member 36. The rearwardmost edge of layers 40, 42 is located rearward of all the metatarsal heads. All the metatarsal heads are thus covered by forepart section 16. As seen in FIG. 1, only six lace holes are used rather than seven or eight to allow forepart section 12 to extend above all the metatarsal heads. When the leather inner layer 40 stretches, it can mold itself to the particular shape of the metatarsal heads of the wearer. Thus, the inner layer 40 can stretch to mold itself to the forepart portion of the foot of a wearer of shoe 10. The forepart portion of the foot includes the toes, and preferably, but not necessarily, the metatarsal heads.

To present a smooth edge along the exposed junction between forepart section 16 and main body section 18, outer layer 42 is folded around the rearward edge of inner layer 40 to lie underneath inner layer 40 along the stitching between sections 16 and 18.

In the assembled shoe 10, a slight gap 52 exists between the outer surface of inner layer 40 and the inner surface of outer layer 42 along their unconnected portions. While the gap varies in width, in a preferred form of the invention, the gap has an average width in the range of 1/16 to 1/32 of an inch when the inner layer 40 is in a taut but unstretched condition.

The gap 52 can be formed by the technique used in manufacturing the shoe, in particular in the manner of lasting the upper 12. The inner and outer layers 40, 42 are first cut on a common die, i.e., on one or more dies having the same shape and size. The inner and outer layers are thereafter sewn to one another along at least a portion of their peripheries. Thereafter, the inner and outer layers 40, 42 are stitched to the main body section 18 and the last hole reinforcement member 36 and then stretched over a last to form the upper. During the stretching over the last, inner layer 40 stretches a slight amount. After removal from the last and attachment to the midsole layer 22 of sole 14, inner layer 40 returns to an unstretched condition and the slight gap 52 is formed.

While the mesh material of outer layer 42 is nonstretchable, outer layer 42 will move along the bias of the mesh. As seen in FIG. 2, it is preferred that outer layer 42 be oriented so that the bias of the mesh material, indicated by arrow 54, is at an angle to the longitudinal dimension of shoe 10 as indicated by arrow 56. In this manner, the forepart section will resist movement in the forward and aft directions, as well as in the side-to-side direction, while permitting motion diagonally or at an angle relative to the lengthwise dimension of the shoe.

Numerous characteristics and advantages of the invention have been set forth in the foregoing description, together with details of the structure and function of the invention and the novel features thereof are pointed out in the appended claims. The disclosure, however, is illustrative only, and changes may be made in detail, especially in matters of shape, size, and arrangement of parts, within the principal of the invention, to the full extent indicated by the broad general meaning of the terms in which the appended claims are expressed.

I claim:

1. In an athletic shoe comprising a sole and an upper attached to the sole the improvement comprising:

a multi-layered forepart section of the upper for extending around the forepart portion of the foot of a wearer of the athletic shoe, said forepart section including an inner layer of stretchable and moldable material and an outer layer of breathable, flexible and nonstretchable material extending about said inner layer of material, said inner and outer layers being permanently attached to said shoe, a major portion of the inner layer being unconnected to the outer layer whereby the inner layer is free to stretch a degree limited by the extent of the outer layer of nonstretchable material to accommodate and mold to the forepart of the foot of the wearer.

2. In an athletic shoe in accordance with claim 1 wherein said inner layer is joined to said outer layer substantially only along the edges of the forepart section where the inner and outer layers join with the sole and with the remaining portion of the upper.

3. In an athletic shoe in accordance with claim 1 wherein said outer layer is comprised of a nonstretchable mesh material.

4. In an athletic shoe in accordance with claim 3 wherein said nonstretchable mesh material is nylon.

5. In an athletic shoe in accordance with claim 1, 2, 3 or 4 wherein said inner layer is formed of leather.

6. In an athletic shoe in accordance with claim 5 wherein said leather is split cowhide having a weight of less than four ounces.

7. In an athletic shoe in accordance with claim 6 wherein said split cowhide is two ounce split cowhide.

8. In an athletic shoe in accordance with claim 5 wherein said leather is pigskin having a weight less than three ounces.

9. In an athletic shoe in accordance with claim 5 wherein the leather of said inner layer is perforated.

10. In an athletic shoe in accordance with claim 9 wherein the perforations in said leather are approximately one-sixteenth of an inch in diameter.

11. In an athletic shoe in accordance with claim 5 wherein the leather of said inner layer is a preselected type of leather having a weight less than is required to form a forepart section solely from the preselected type of leather which would not stretch out of shape.

12. An athletic shoe comprising:

a sole having a lower surface for contacting the ground; and an upper connected to said sole, said upper including a forepart section for extending around the forepart portion of the foot of a wearer of the athletic shoe, said forepart section having an inner layer of a stretchable and moldable leather or leather-like material and an outer layer of a nonstretchable and flexible synthetic mesh material extending about said inner layer of material, said inner and outer layers both being attached along their respective lower areas to said sole and along their respective rearward edges to the remainder of the upper, the portions of the inner and outer layers not connected to the sole and the remainder of the upper being substantially unconnected to one another to leave a slight gap between the inner surface of the outer layer and the outer surface of the inner layer whereby said inner layer is permitted to stretch a degree limited by the extent of the outer layer of nonstretchable material to accommodate and mold to the forepart portion of the foot of a particular wearer without stretching excessively out of shape.

13. An athletic shoe in accordance with claim 12 wherein said gap has an average dimension in the range of approximately 1/32 to 1/16 of an inch.

14. An athletic shoe in accordance with claim 12 wherein said inner and outer layers of said forepart section are attached to said sole on the medial side of said shoe from a point rearward of the first metatarsal head of the foot of a wearer of the shoe forwardly to the forward end of the sole and backward therefrom along the lateral side of the shoe to a point rearward of the fifth metatarsal head of the foot of a wearer of the shoe.

15. An athletic shoe in accordance with claim 14 wherein said rearward edges of said inner and outer layers of said forepart section extend upward and forward from their points of attachment to the sole on the medial and lateral sides of said shoe.

16. An athletic shoe in accordance with claim 14 wherein said rearward edges of said inner and outer layers are located rearward of all of the metatarsal heads of the foot of the wearer of the shoe whereby the inner layer can stretch a limited degree to mold to the particular metatarsal heads of the wearer of the shoe.

17. An athletic shoe in accordance with claim 14, 15 or 16 wherein said outer layer is made of a nonstretchable nylon mesh material.

18. An athletic shoe in accordance with claim 17 wherein said nylon mesh material is a monofilament material.

19. An athletic shoe in accordance with claim 17 wherein said inner layer is made of a leather having a weight of three ounces or less.

20. An athletic shoe in accordance with claim 19 wherein said leather inner layer is perforated.

21. An athletic shoe comprising:

a sole having a lower surface for contacting the ground; and an upper attached to said sole, said upper including a forepart section for extending around the forepart portion of the foot of a wearer of the athletic shoe, said forepart section having an inner layer of a stretchable thin leather and an outer layer of a nonstretchable and flexible synthetic mesh material extending about said inner layer of material, said inner and outer layers both being attached along their respective lower areas to said sole on the medial side of said shoe from a point rearward of the first metatarsal head to the forward end of the sole and along the lateral side of the sole from the forward end to a point rearward of the fifth metatarsal head and along their respective edges to the remainder of the upper rearward of all the metatarsal heads, the portions of the inner and outer layers not connected to the sole and the remainder of the upper being substantially unconnected to one another to leave a slight gap between the inner surface of the outer layer and the outer surface of the inner layer whereby said leather inner layer is permitted to stretch a degree limited by the extent of the outer layer of nonstretchable material to accommodate and mold to the forepart portion of the foot of a particular wearer without stretching excessively out of shape.

22. An athletic shoe in accordance with claim 21 wherein said nonstretchable synthetic mesh material is a monofilament nylon.

23. An athletic shoe in accordance with claim 22 wherein said monofilament nylon is at least 400 denier.

24. An athletic shoe in accordance with claim 22 or 23 wherein said mesh material has a square weave.

25. An athletic shoe comprising:

a sole having an outer sole layer and a midsole layer, said outer sole layer being formed of a resilient material and having a lower surface for contacting the ground and an opposite upper surface, said midsole layer being attached to the upper surface of said outer sole layer and being formed of a resilient material less hard than the material of said outer sole layer; and an upper attached to said midsole layer, said upper including a forepart section for extending around the forepart portion of the foot of a wearer of the shoe, said forepart section having an inner layer of a stretchable leather or leather-like material and an outer layer of a nonstretchable and flexible synthetic mesh material extending about said inner layer of material, said inner and outer layers each having lower portions attached to said sole, rear edges attached to the remainder of said upper and unconnected portions not attached to one another, said unconnected portions extending between said attached lower portions and said rear edges, a slight gap being formed between the outer surface of the unconnected portion of said inner layer and the inner surface of the unconnected portion of said outer layer whereby said inner layer is permitted to stretch a degree limited by the extent of the outer layer of nonstretchable material to accommodate and mold to the forepart portion of the foot of the wearer without stretching an excessive amount.

26. An athletic shoe in accordance with claim 25 wherein the mesh material of said outer layer is attached to said sole with the bias of the mesh oriented at an angle to the longitudinal direction of the shoe whereby motion of the mesh material along its bias occurs at an angle relative to the longitudinal direction of the shoe.

27. An athletic shoe in accordance with claim 26 wherein said mesh material is made of a monofilament nylon having a square weave.

28. An athletic shoe in accordance with claim 26 or 27 wherein said inner layer is made of a leather having a weight of three ounces or less.

29. An athletic shoe in accordance with claim 25 wherein said outer layer is made of a nonstretchable nylon mesh.

30. An athletic shoe in accordance with claim 25 wherein said rearward edges of said inner and outer layers are located rearward of all of the metatarsal heads of the wearer of the shoe whereby the inner layer can stretch a limited degree to mold to the particular metatarsal heads of the wearer.

31. In a method of manufacturing an athletic shoe having a sole and an upper attached to it, with the upper having a forepart section comprised of a stretchable leather inner layer and a synthetic mesh nonstretchable outer layer, comprising the steps of:

cutting the leather inner layer and the mesh outer layer on dies having the same shape and size;

stitching the inner layer to the outer layer along at least a portion of the borders of the layers;

attaching a rearward edge of the inner and outer layers to the remainder of the upper;

forming the upper about a last to stretch the leather inner layer;

attaching the sole to the upper; and removing the upper from the last and allowing the inner layer to shrink from its stretched condition on the last to form a slight gap between the outer surface of the inner layer and to inner surface of the outer layer.

* * * * *

UNITED STATES PATENT AND TRADEMARK OFFICE

CERTIFICATE OF CORRECTION

PATENT NO. : 4,438,574

DATED : March 27, 1984

INVENTOR(S) : Jeffrey O. Johnson

It is certified that error appears in the above—identified patent and that said Letters Patent is hereby corrected as shown below:

Column 1, line 41, after "has to be struck between the", "length of" should read --strength or--; and Column 2, line 37, after "around the", "shoes" should read --toes--.

Signed and Sealed this

*Twelfth* Day of *June 1984*

[SEAL]

*Attest:*

GERALD J. MOSSINGHOFF

*Attesting Officer*

*Commissioner of Patents and Trademarks*